US006004011A

United States Patent [19]

Sieczkowski

[11] Patent Number: 6,004,011

[45] Date of Patent: Dec. 21, 1999

[54] RECESSED LAMP FIXTURE

[75] Inventor: Philip Sieczkowski, Moore, S.C.

[73] Assignee: Progress Lighting, Inc., Spartanburg, S.C.

[21] Appl. No.: 08/962,850

[22] Filed: Nov. 3, 1997

Related U.S. Application Data

[62] Division of application No. 08/650,077, May 17, 1996, Pat. No. 5,758,959.

[51] Int. Cl.[6] ..... F21S 1/02

[52] U.S. Cl. ..... 362/365; 362/370

[58] Field of Search ..... 362/364, 365, 362/366, 370, 371, 147

[56] References Cited

U.S. PATENT DOCUMENTS 5,440,471 8/1995 Zadeh ..... 362/365

5,452,193 9/1995 Hinnefeld et al. ..... 362/366

*Primary Examiner*—Stephen Husar

*Attorney, Agent, or Firm*—Seidel, Gonda, Lavorgna & Monaco

[57] ABSTRACT

A recessed lamp fixture having a minimal plaster frame and a lamp housing. The plaster frame comprising a mounting bracket is adapted to receive a variety of differently sized and shaped lamp housings. The housing comprises an integrated lamp and trim assembly that is retained within the housing by a biased retaining spring. The housing is designed with minimal openings for reduced heat loss and air flow. The frame further comprises an integrated junction box and hanger bar system adapted to mount the fixture behind a panel. The junction box and the lamp housing also comprise an electrical power line retaining means to securely fasten the line to the box and housing. The hanger bar is slideably attached to the frame with ends that are designed to engage ceiling and wall supporting structures without the need for additional fasteners. Another feature of the invention resulting from the design of the frame and housing is a unique method of manufacture, whereby a minimal number of steps is required to assemble the fixture.

18 Claims, 8 Drawing Sheets

FIG. 7
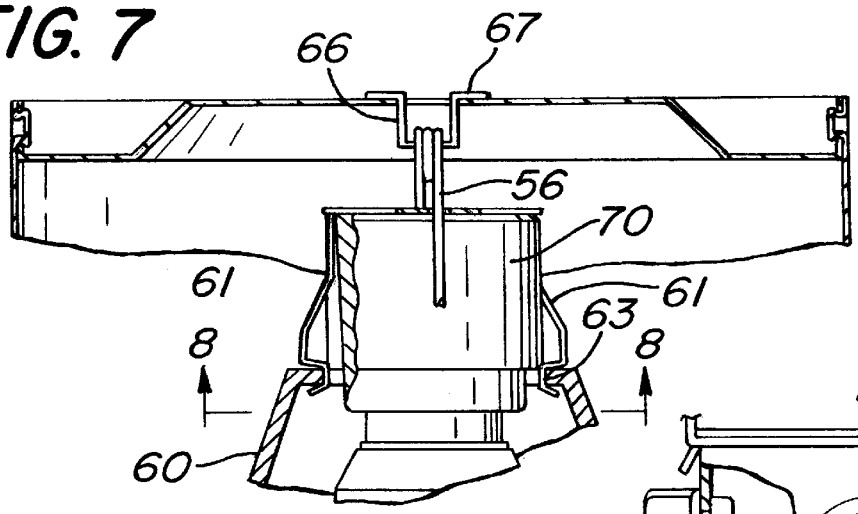
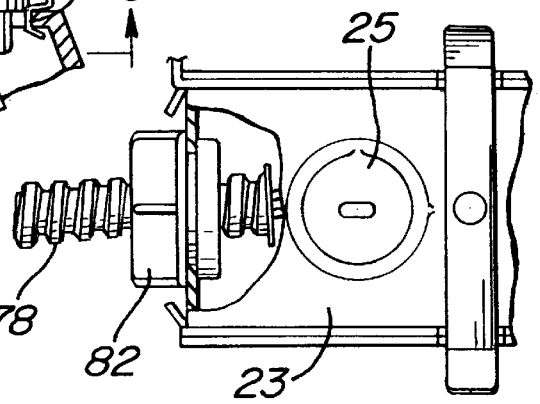
FIG. 10
FIG. 9
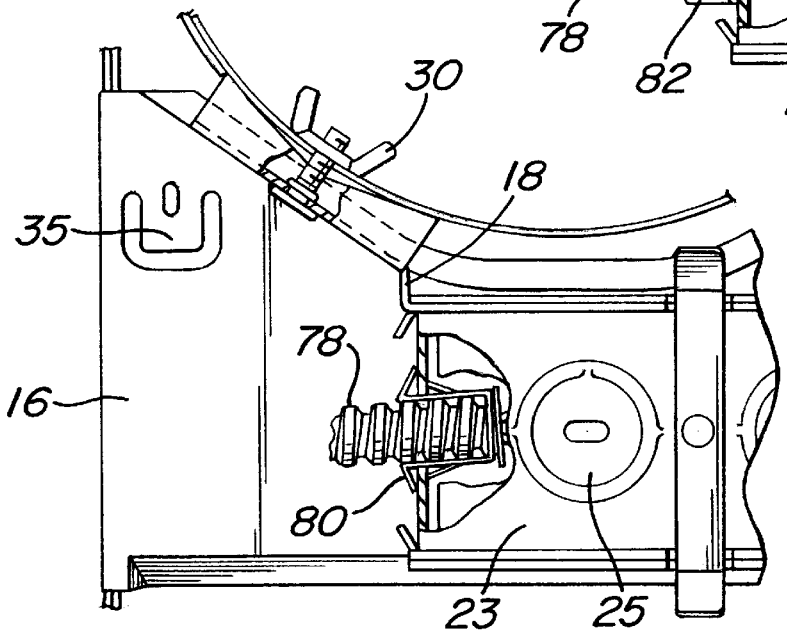
FIG. 8
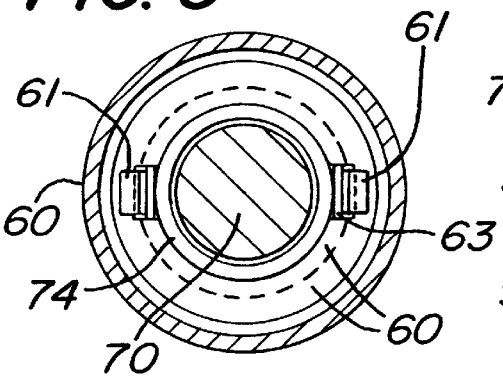
FIG. 11
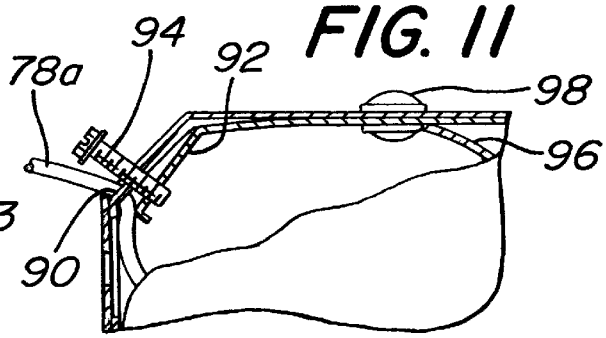

RECESSED LAMP FIXTURE

This is a divisional of application Ser. No. 08/650,077, filed on May 17, 1996 now U.S. Pat. No. 5,758,959.

BACKGROUND OF THE INVENTION

This invention relates to an apparatus for a recessed lamp fixture.

Recessed lamp fixtures are widely used in residential, commercial and institutional settings to provide light in a selective decorative manner.

Most recessed lamp fixtures are made with a full "plaster frame" for mounting the fixture behind a ceiling or wall panel, with a lamp housing permanently affixed to the frame in a non-selectable manner. The traditional construction of recessed lamp fixtures, however, fails to satisfy the more recent need for efficiently constructed and performing fixtures.

Mandatory building codes and standards require recessed light fixtures to be more efficient and result in reduced weight, size, airflow allowances, power consumption, and cost of operation. To meet this need the entire fixture, including the plaster frame and lamp housing, must have more integrated assemblies, reduced parts, size, weight and cost. In order to reduce airflow through the fixture, seams and openings for fasteners must be sealed or eliminated. These fixtures must also be rapidly adaptable for installation, in various locations, with minimal preparation and fastener requirements.

In addition, there is a clear economic benefit to having a recessed fixture that provides interchangeability of parts, particularly with regard to lamp housings, reflectors and trim rings of various shapes and sizes. This demand is addressed by the present invention by providing a common mounting frame with interchangeable lamp housings and other components.

SUMMARY OF THE INVENTION

In one aspect of the present invention, a recessed-lighting fixture includes a cylindrical housing which is open at one end, with a lamp socket assembly retained in the cylindrical housing by a biased retaining device. One end of the retaining device is attached to the closed end of the cylindrical housing, and the other end is attached to the base of the lamp assembly. A trim ring is also attached to the lamp assembly. The retaining device draws the lamp assembly into the housing body until the trim contacts the wall panel, covering the gap between the perimeter of the housing and a mounting hole in the wall panel when the fixture is mounted.

In another aspect of the invention, the recessed-lighting fixture includes a mounting frame with a mounting plate that is adapted to receive cylindrical housings of various diameters. A selectively-positionable fastening device attaches the housing to the mounting plate at various heights.

In another aspect of the invention, the recessed-lighting fixture's mounting frame includes a hanger device integrated into the mounting frame. The two opposite ends of the hanger(s) have built in fastener points to engage the supporting structure of exterior wall or ceiling panels. The hanger ends are also designed to engage the supporting structure associated with suspended tile ceilings, including those having a "T" Grid.

In another aspect of the invention, a mounting plate for attaching the lamp housing is located at one end of the mounting frame, and a hanger means is integrated into at least one side of the mounting frame. A junction box is also integrated into the frame and encloses the junctions of electrical supply wiring to the recessed-lighting fixture.

In another aspect of the invention, the hanger has two flexible metal plates. Each plate has a first and a second end, and a channel complementary to each other formed substantially along their entire length. A retaining clip engages and retains the two flexible metal plates. The retaining clip has two arms for engaging the channels of the metal plates. The clip, retains the two plates together while allowing them to slide in a linear fashion to the full extent of the channel lengths.

In another aspect of the invention, the lamp housing has a minimum number of openings, sealed seams and reduced airflow openings. The housing body and top have overlapped ends fastened together by a metal stitching technique commonly known as "Tox-Loc" stitching, which produces an essentially air-tight seam. A single opening is made near the middle of the housing body for accepting a mounting stud for fastening the housing to the mounting frame. This opening is filled by the stud fastener when the housing is securely mounted to the frame. Another opening is made near the top of the housing body for the electrical supply line. The lamp housing constructed in this manner has two filled openings on its top to accept a spring mounting bracket, and filled openings on it's side for the mounting fastener and the supply line, thereby minimizing airflow and heat loss.

It is an object of the present invention to provide an improved recessed- lighting fixture. This and other features, aspects, and advantages of the present invention will become better understood with reference to the following descriptions, drawings, and appended claims.

BRIEF DESCRIPTION OF THE DRAWINGS

For the purpose of illustrating the invention, the drawings depict one or more embodiments of the invention. However, the scope of the invention is not limited to the precise arrangements and instrumentalities shown.

FIG. 7 is a partial section view of the embodiment depicted in FIG. 6, taken along the lines and in the direction indicated by the arrows 7—7 of FIG. 6.

FIG. 8 is a section view of the embodiment depicted in FIG. 7, taken along the lines and in the direction indicated by the arrows 8—8 of FIG. 7.

FIG. 9 is a partial top view of the embodiment depicted in FIG. 2 of the junction box, in exposed view, showing the housing electrical line and the mounting bracket.

FIG. 10 is a partial top view of the embodiment depicted in FIG. 2 of the junction box, in exposed view, showing the installation of an armored supple line and fitting in accordance with the present invention.

FIG. 11 is a partial side view of the embodiment depicted in FIG. 2 of the junction box, in exposed view, showing the installation of a flexible supple line in accordance with the present invention.

DETAILED DESCRIPTION

Figure 1:
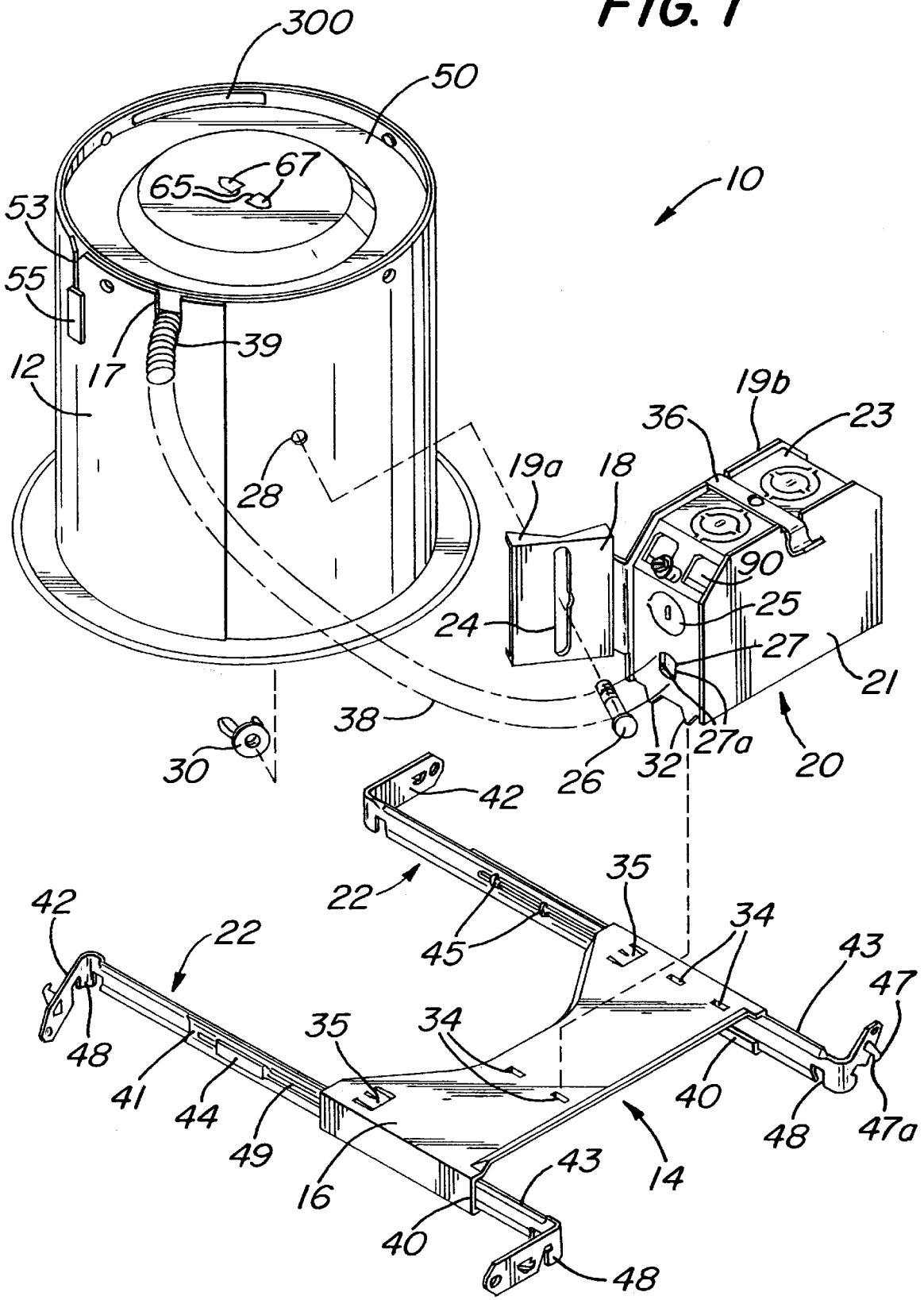
FIG. 1 is an exploded isometric view of a preferred embodiment of a recessed lamp fixture in accordance with the present invention.

Referring to the drawings, wherein like numerals indicate like elements, FIG. 1 shows an exploded view of the main components of a recessed lamp fixture 10 in accordance with the present invention. Those components include a cylindrical lamp housing 12 and a mounting frame 14 adapted to receive and support the lamp housing. The mounting frame includes a mounting plate 16 (or "plaster frame" in the terminology of the art), a mounting bracket 18, an electrical junction box 20, and a pair of hanger bars 22. Where at times it may be instructive to refer to specific sides of the mounting plate, it will be in the orientation depicted in FIG. 1, such that the mounting plate 16 has a right side, a left side, a back side and a front side. The front side of the plate 16 has a concave curvature to accommodate a cylindrical lamp housing of various diameters, preferably between four to six and one-half inches.

Figure 2:
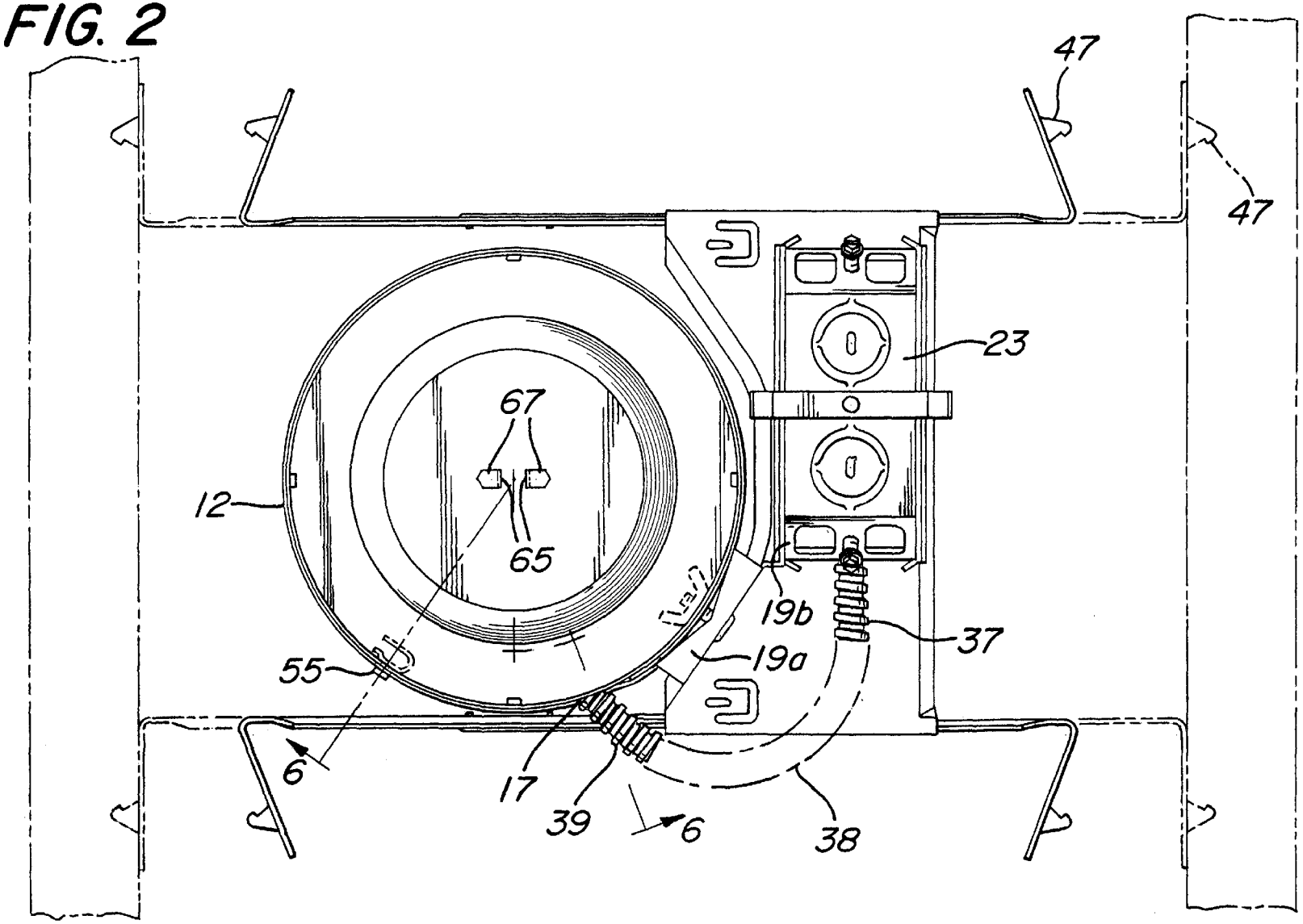
FIG. 2 is a top view of the embodiment depicted in FIG. 1 positioned between ceiling joists.

The mounting bracket 18, as shown in FIG. 2, has a shallow "V-shaped" face 19*a*, disposed away from the mounting frame, which is adapted to contact and grip a cylindrical lamp housing of various diameters, preferably between four to six and one-half inches. This feature permits the use of a uniform or standard-size mounting frame with different diameter lamp housings, and thus a modular assembly which does not require a different plaster frame for each diameter lamp housing.

The bracket 18, as shown in FIG. 1, further has a vertical slot 24, preferably about two inches in length, adapted to receive a captive bolt 26. The bolt is of sufficient length to pass through a hole 28 in the housing and is threaded to receive a wing nut 30 to clamp the housing against the V-shaped face of the mounting bracket when tightened. This arrangement provides a height-adjustable fastening mechanism for mounting the housing to the frame, in which the housing can be vertically positioned within about two inch range relative to the mounting frame.

The mounting bracket 18 is preferably integral with a side wall 19*b* of the junction box 20. The junction box wall 19*b* is supported by the mounting plate 16, and the junction box frame 23.

The junction box 20 is formed in sections by the side wall 19*b* extension of the mounting bracket, an opposite cover plate 21, and a frame 23 with punch-out access slots. The junction box frame 23 is attached to the mounting plate by a series of interlocking keys 32 which lock into matching key holes 34 in the mounting plate 16. The box is maintained in an upright position, and the cover plate retained in place by a retaining clip 36.

A electrical power cable housing 38, as shown in FIG. 2, runs from the junction box into the lamp housing 12. The preferred power cable is a metal shielded conduit with threaded connector ends 37,39. One threaded end 37 can be screwed into an access slot of the junction box, and the other end 39 is fitted into an opening 17 at the top end of the lamp housing.

A significant feature of the housing is a reduction in the number of openings. When assembled, the housing body has only an opening at its bottom for access to the light source. Referring to FIG. 1, the captive bolt 26 substantially fills the middle housing opening 28, and the power cable 38 substantially fills the top housing opening 17. This feature provides for enhanced efficient assembly and reduced airflow through the housing.

Adjustable-length hanger bars 22 secure the recessed lamp fixture to joists or other support structure behind a wall or ceiling panel. As shown in FIG. 2, the hanger bars are retained by and slide within retaining channels 40 which are formed in the right and left sides of the mounting plate 16.

Figure 5:
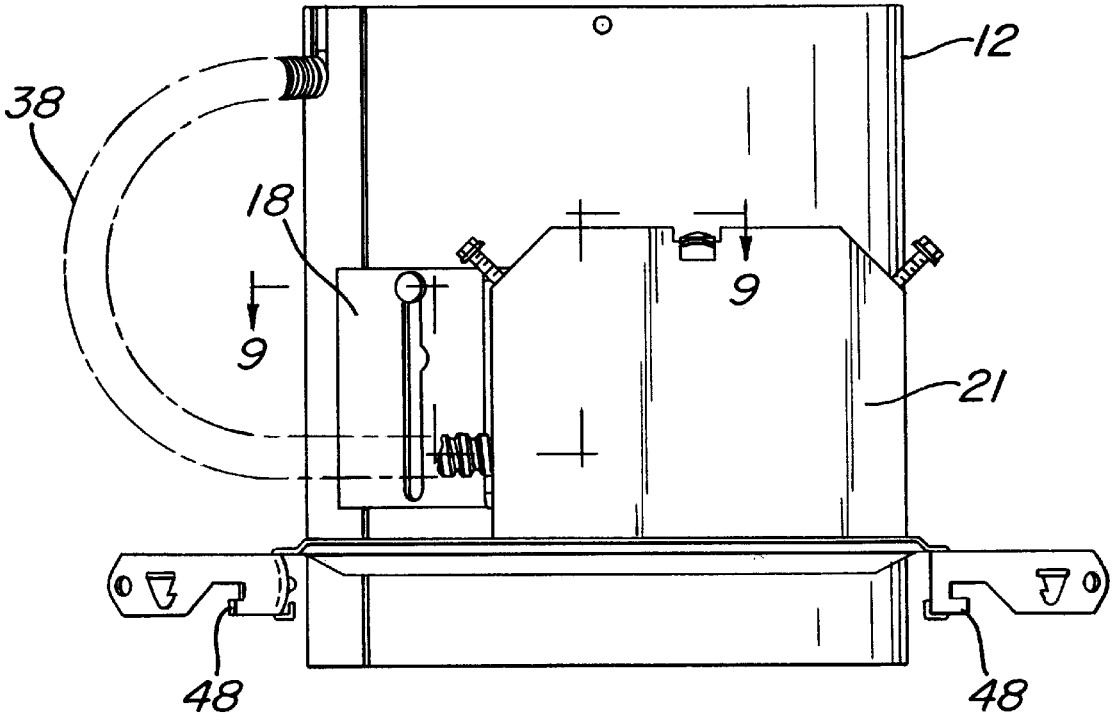
FIG. 5 is a front view of the embodiment depicted in FIG. 2 taken from the lower side of FIG. 2.

The adjustable-length hanger bars are comprised of two sections 42, 43 slideably connected to each other. Each section has a fastener end with a nailer tab 47 which can be used as a tack for securing the fixture to a wooden joist. The nailer tab 47 has a barbed end 47*a* which acts like a fish-hook to prevent disengagement of the nailer from the wooden joist. In addition, each section also has a flexible tab 48 to secure the fixture to a T-grid ceiling channel of the type commonly used to support ceiling tiles. The hanger bar sections are prevented from sliding apart by a retaining clip 44. The retaining clip 44 has two locking tabs 45 for engaging both sections 42, 43 of a single hanger bar 22. Referring to FIG. 5, the retaining clip 44 slides in a channel 41 formed by longitudinal edges of the hanger bar sections.

A significant feature of the hanger bars is that they can be removed from or inserted into the mounting frame by manipulating the channel hanger bar retaining tab 35. In addition, the hanger bars can be removed so they can be bent into shape to better facilitate the installation mounting requirements. This feature is particularly useful for confined installation conditions. The two hanger bars retained by the retaining clip 44 can be easily separated by manipulating the locking tab 45, and removing one of the hanger bar sections 42, 43.

Another significant feature of the hanger bars is that they can slide freely in the channel 40 of the mounting plate 16 when held together by the retaining clip 44.

Figure 6:
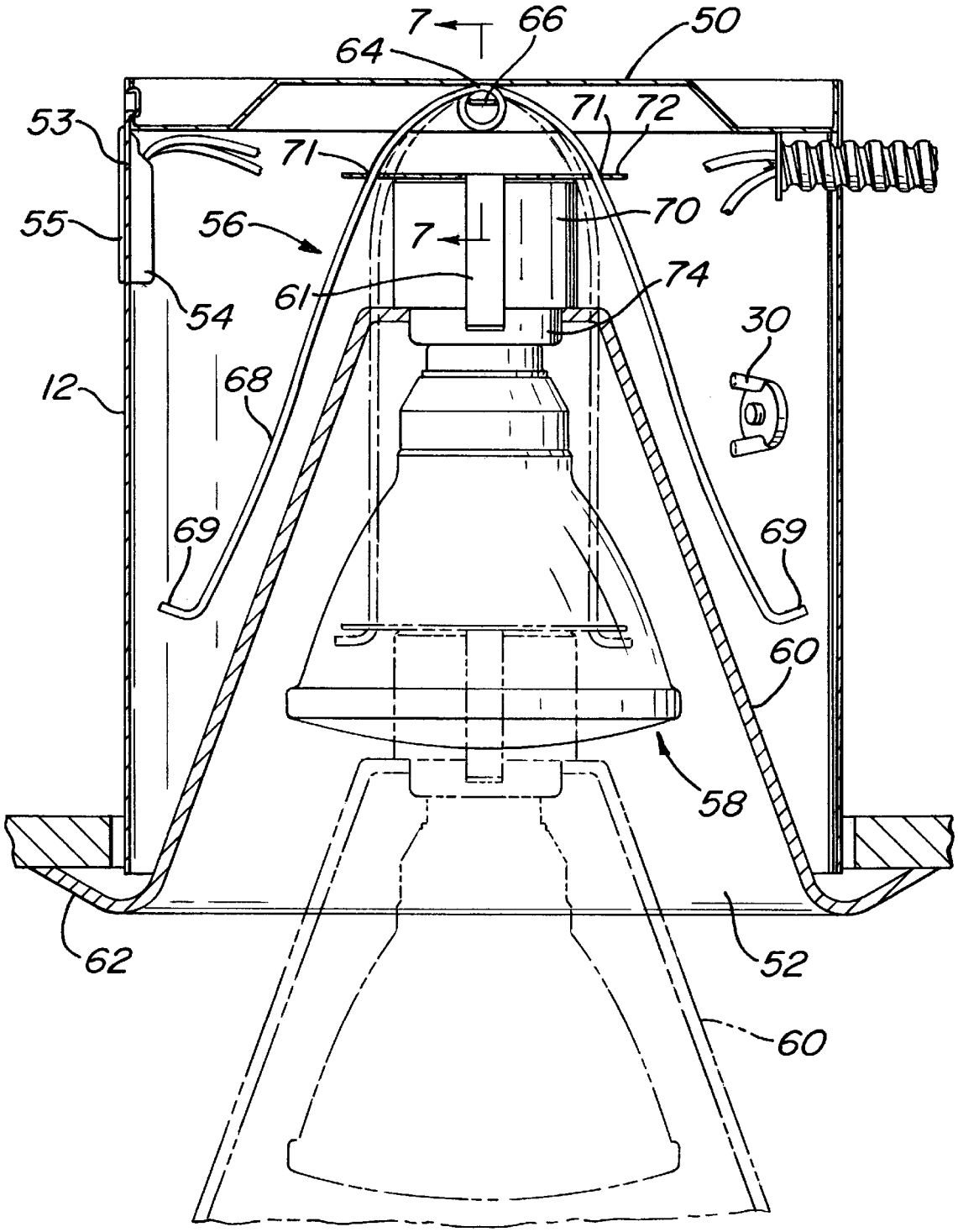
FIG. 6 is a section view of the embodiment depicted in FIG. 2, taken along the lines and in the direction indicated by the arrows 6—6 of FIG. 2.

Referring now to FIG. 6 for the purpose of describing significant features within the lamp housing 12, it shows that the cylindrical housing has a closed top end 50 and an open bottom end 52. A thermal safety switch 54 has a retaining tab 55 that engages a slot 53 near the top of the lamp housing 12.

Significant features within the housing include a biased retaining spring 56, a lamp assembly 58, and a reflector cone 60 with an integral trim ring 62. In this preferred embodiment, the biased retaining spring 56 has a single-coil fixed end 64 and two fork arms 68 with flared tips 69. The retaining spring 56 is retained in the housing top 50 by a bracket 66. The bracket 66 is secured to the housing top 50 by bracket ends 67 which engage openings 65 in the housing top.

The lamp assembly 58 includes a base portion 70 with a flange 72 and a lamp receiving socket 74. The reflector cone 60 and trim ring 62 are attached directly to the base 70, and retained in place by a retainer clip 61 as shown in FIG. 8. It is to be understood that the trim ring can be integral with the reflector cone as shown in FIG. 6, or separate from the reflector cone (not shown.) The retainer clips 61 engage the reflector cone 60 through slots 63 in the top of the reflector cone. The forks 68 of the biased retaining assembly 56 extend through slots 71 in the base flange 72.

As shown by the ghost lines in FIG. 6, the lamp assembly and attached reflector/trim ring can be pulled down out of the housing until the flared tips 69 of the spring forks catch against the base flange 72. The forks are compressed toward each other as they slide through the slots in the flange, and thus provide a force biased toward retracting the lamp assembly back into the housing. As the assembly is retracted from the housing, and at a predetermined point along its retractable path, the retracting force is reduced to zero or neutralized thereby enabling the lamp assembly to be at rest when it is fully extended. When the lamp assembly is inserted back into the housing, and at a predetermined point along its retractable path, the retracting force of the spring bias engages the lamp assembly and draws it into the housing until the trim makes contact with a ceiling or wall panel.

Figure 12:
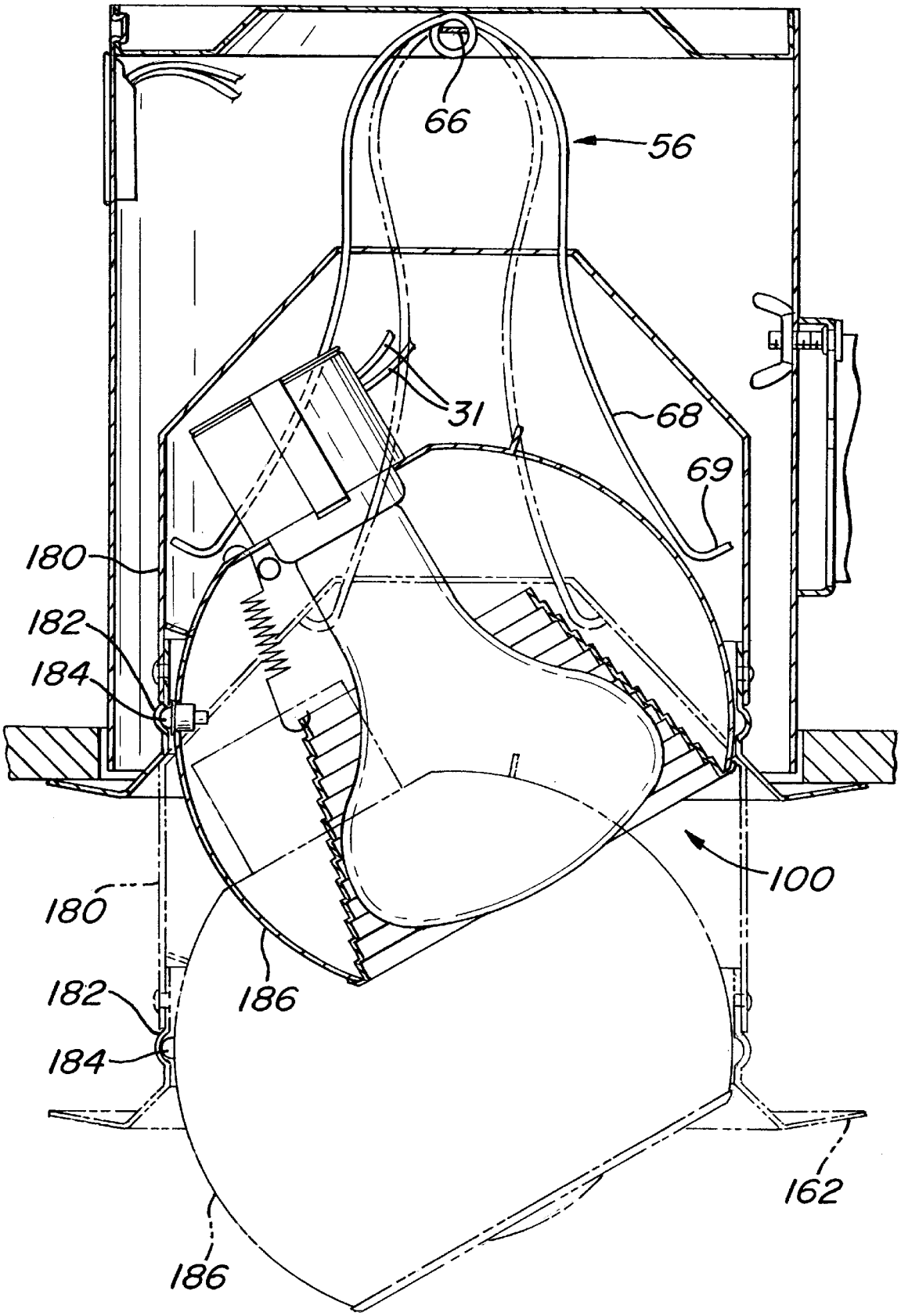
FIG. 12 shows a section view of a preferred embodiment of a recessed lamp fixture having an "Eye Ball" lamp housing in accordance with the present invention.

An alternative embodiment is shown in FIG. 12 in which the lamp assembly is a pivoting "Eye-ball" type 100, which can be angled within the housing. In this embodiment, the lamp assembly includes a hanger bracket 180 with pivot sockets 182, into which are inserted pivot-point bearings 184 mounted on a lamp shroud 186. The reflector cone 160 is attached inside the shroud, and the trim ring 162 is attached to the hanger bracket. In this embodiment the forks of the spring pass through slots in the hanger bracket, but the operation of the spring as a retracting bias is essentially the same as in the first embodiment.

Figure 13:
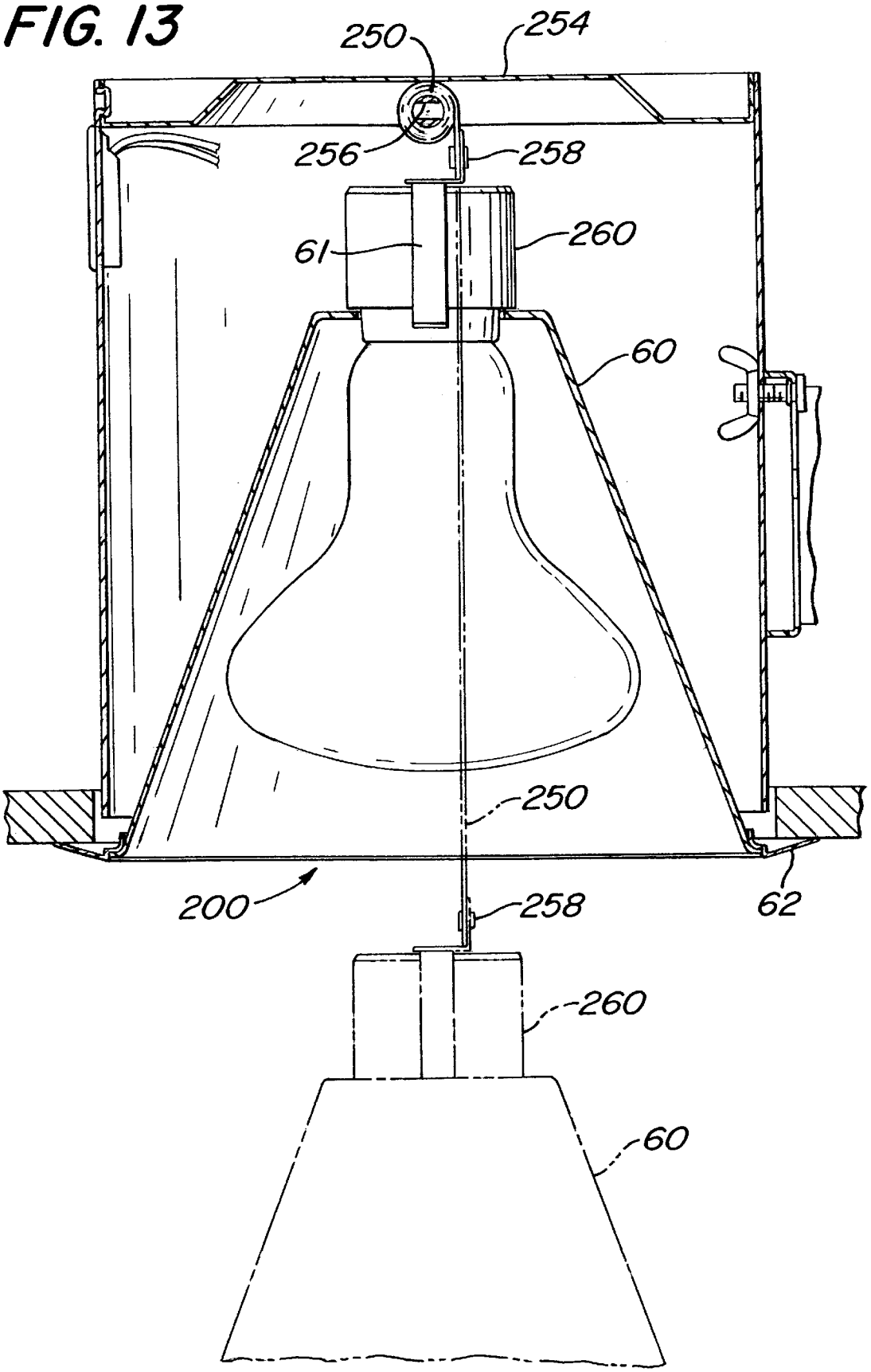
FIG. 13 shows a section view of a preferred embodiment of a lamp housing and biased retaining means having a constant force spring in accordance with the present invention.

Another alternative embodiment is shown in FIG. 13 in which the biased retaining spring 250 is a constant-force coil spring. The spring 250 has a fixed end retained in the housing top 254 by a bracket 256 which is attached to the housing top, and a free end 258, which is directly attached to the base 260 of the lamp assembly 200. As shown by the ghost lines in FIG. 12 the lamp assembly and attached reflector/trim ring can be pulled down out of the housing until the coil spring 250 is fully extended and thus provides a force biased toward retracting the lamp assembly back into the housing. When the lamp assembly is released, this spring bias draws the lamp assembly into the cylindrical body until the trim makes contact with a ceiling or wall panel.

Reduction of Air Leakage.

The fixture is preferably manufactured in a manner which reduces the volumetric rate of air flow through the housing sufficiently to meet exacting insulating and non-insulating standards established in the building and lighting industries. To the extent necessary, the following building and lighting industry standards: Underwriters Laboratories Inc.® 1571, (hereafter "UL 1571") Washington State Energy Code, and ASTM E283-84 are incorporated by reference herein. Specifically, the light fixture is designed, shaped and dimensioned to reduce all fixture openings in order to obtain a preferred maximum volumetric rate of air flow of 2 CFM at a pressure 22 PSI when installed.

To meet this requirement it is necessary to reduce the number and size of openings in the housing, or to close and cover the unavoidable holes. This begins with the initial stamping of the housing components. The body of the cylindrical housing 12 may be formed by stamping a roll of metal to form a rectangular plate with a hole (fastener hole 28) and with a slot 17 that opens onto one longitudinal side of the plate and which will become the opening for cable end 39 to pass into the housing. The rectangular plate is then formed around a cylindrical mandril to make a cylindrical body with overlapping ends. The overlapped ends are then fastened together by a metal stitching technique commonly known as "Tox-Loc" stitching, which produces an essentially air-tight seam.

The housing top is formed by stamping a metal sheet to form a circular plate with an inverted bowl-like depression in the center and two small fastener openings spanning its center-point, another fastener opening just inside the perimeter, and a raised lip around the entire perimeter. The bracket 66 for the retaining spring can then be attached to the housing top by bracket ends 67 inserted through the small openings 65, where the bracket ends 67 are folded over to seal the openings and support the assembly.

The threaded connector end 39 of the metal shielded electrical cable 38 is inserted in the slot opening of the cylindrical body. The slot width is between the outer diameter of the grooves and lands of the treading. Then the housing top is placed inside the top end of the cylindrical body until it the connector end, which closes the slot opening and secures the cable. The top end of the cylindrical body and the raised lip of the housing top are fastened together by the "Tox-Loc" or similar metal stitching. The housing 12 is then only open at the bottom end and at the mounting hole 28. The mounting hole will be covered by the wing-nut 30 when the housing is mounted to the frame, leaving an essentially sealed container except for small gaps around the cable connector. This configuration eliminates the many air leakage holes of prior housings, and will meet or exceed the standard of not more than 2 CFM flow-through at 22 PSI.

Another important feature of this invention is that the trim 62 is also sized and shaped to cover the gap between the housing and the structure further reducing the flow of air through the fixture when installed. As a result of providing a reduced air flow fixture it can be installed with the same trim in either a non-insulated or a insulated installation in accordance with UL 1571.

Installation of the Fixture.

Another important feature of this invention is that the lighting fixture includes indicia 300 for identifying the appropriate trim, lamp size, and lamp type for installation in either an insulated or a non-insulated installation also in accordance with UL 1571. The indicia includes a first indictor (not shown) embossed on the surface of the fixture for indicating at least one first trim number, and at least one first lamp size and lamp type. The first indicator is placed onto the surface of the fixture, preferably near the opening of the housing. A second indictor is placed on a removable label 300 that is located over and covers the first indicia. The second indicator is for indicating at least one second trim number, and at least one second lamp size and lamp type.

It is preferred that the first indictor indicate a trim, and a larger lamp size and lamp type requirement associated with a non-insulated installation. The second indicator will indicate a trim, and a smaller lamp size and lamp type requirement associated with an insulated installation. For example, at the time of installation the installer, knowing which condition is applicable, is instructed to either leave undisturbed the second indicator with information for an insulated installation"IC", or remove it to expose the first indicator with information for a non-insulated installation "Non-IC".

The removable label 300 is adhesive backed and capable of being removed by peeling the label away from the fixture so that the first indicator can be exposed. The purpose of this labeling is to provide the installing contractor or user with the full utility of the invention. This invention provides a light fixture with a single trim and housing combination for a variety of lamp sizes and lamp types in compliance with UL 1571. For example, since the fixture can be installed in either an insulated or a non-insulated installation, the contractor need only ensure the correct indicator is displayed on the fixtures surface.

The features which provide ease of installation of the fixture include the hanger bars and their attachment to the mounting frame, the relatively small size and weight of the frame, the adjustable height mounting of the housing to the frame, the junction box, the retaining spring, and the reflector/trim ring. The recessed lamp fixture 10 is designed for use in new construction; however, it can be adapted for use in old work as well. The fixture is typically installed by an electrical contractor during the rough-in and trim-out phases of construction.

Using the embodiment of FIGS. 1–6 of the recessed lamp fixture 10, the lamp assembly 58, and reflector cone 60 with integral trim ring 62, are detachably connected to the fork spring 56. No disassembly of the lamp assembly 58 and trim ring 62 is required upon installation. During the rough-in phase, the installer determines the fixture location, adjusts the hanger bars, and then hammers the nailers 47 into wooden support members (or applies screws to the hanger bar ends in the case of metal support members.) Power supply lines are routed into the junction box assembly 20 before or after the fixture is mounted. The supply lines are secured to the fixture by the junction box by means of the integral retaining plate 92, or by means of a standard wire connector inserted into knock-outlpryout panel 25 adapted into the junction box frame 23.

Another feature of the present invention is the ability to thread an armored power supply line 38 into a specially formed hole 27 having two flat sides 27*a* formed in the junction box frame 23. Power supply connections are made from either side of the junction box assembly 20 by removing the cover 21.

Figure 3:
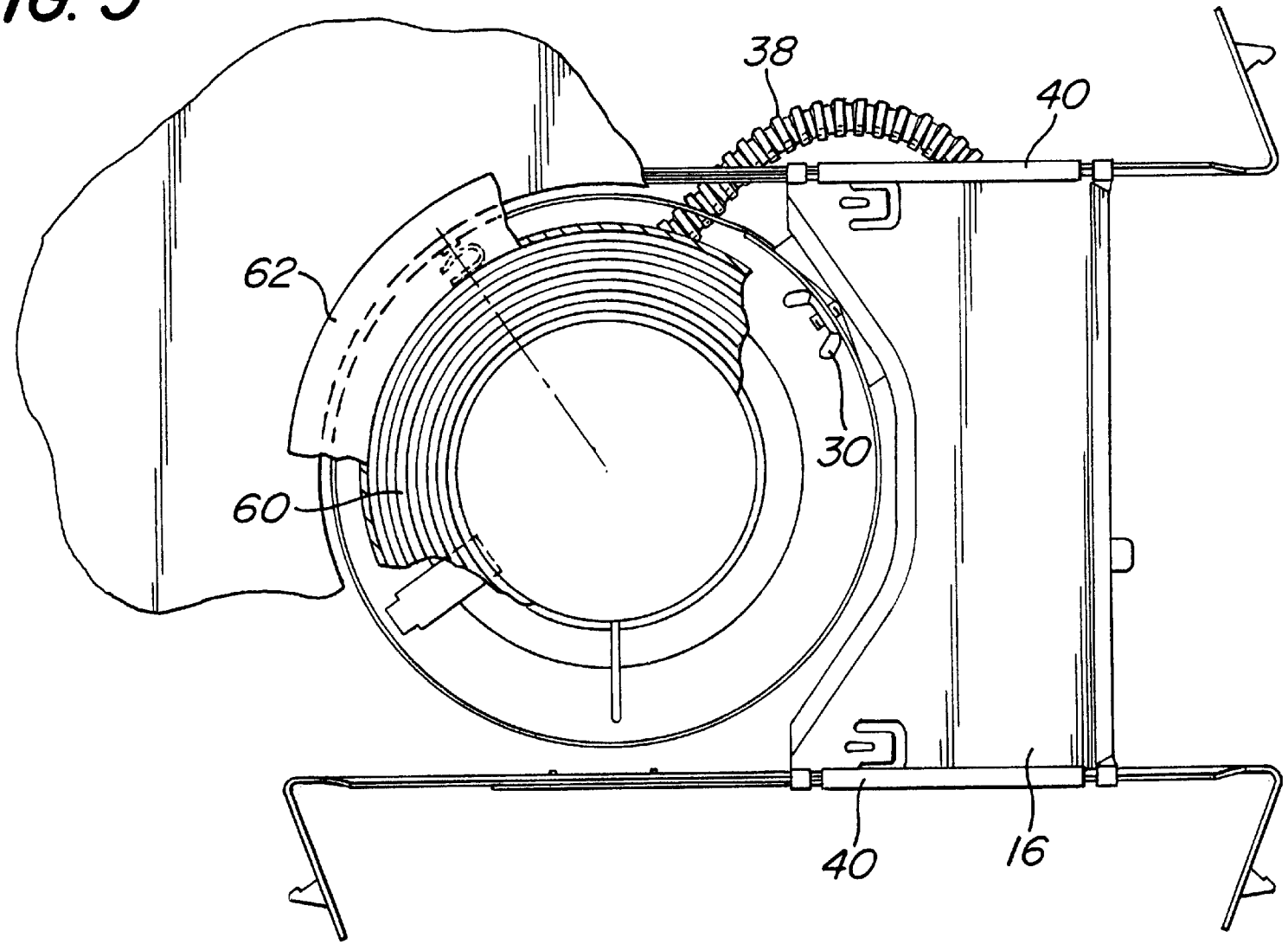
FIG. 3 is a bottom view of the embodiment depicted in FIGS. 1 and 2, positioned in relation to a cut-out section of ceiling panel.

At the point the interior surfaces are finished, the installer returns to install the trim 60 by lowering the base 70 along the length of the fork spring 68 until it is fully distended. The selected trim 60 is now attached by compressing the socket spring retainer clips 61 and inserting them into the properly oriented opening in the trim housing or bracket. When pushed back into the housing, the spring will retract the entire lamp assembly into the housing until the trim ring contacts the ceiling, covering the gap and holding the trim in place as shown in FIG. 3.

An important aspect of the present invention is the adjustment feature of the cylindrical housing 12 for accommodating a range of ceiling thicknesses. The cylindrical housing 12 is lowered or raised on the mounting frame 16 until the housings bottom edge is flush with the ceiling. The adjustment is made by loosening a wing nut 30 used to secure the housing to the frame.

Figure 4:
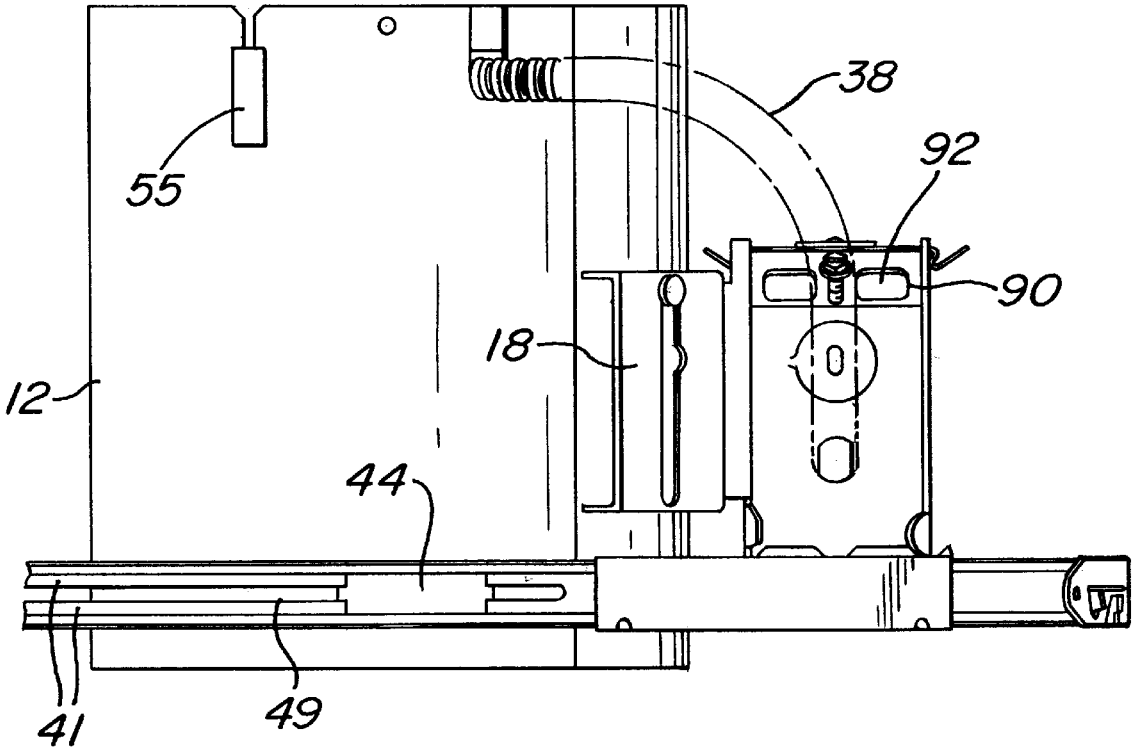
FIG. 4 is a left side view of the embodiment depicted in FIG. 2 taken from the left side of FIG. 2.

Referring to FIG's 9–11 a standard 110 volt electrical supply line 78 can be brought into the junction box and connected to a pair of fixture supply wires 31 located within the metal shielded conduit 38. In FIG. 9 the standard shielded supply line 78 is brought into the junction box and secured by a standard press-in-place fitting 80. In FIG. 10 an alternative connecting system for a standard metal cable is shown utilizing a hole formed by a knockout/pryout panel 25 on the junctions and frame 23. The cable is retained in the hold by a standard fitting 82. In FIG. 11 a standard Romex® cable 78*a* is secured by a specially designed slot 90, retaining plate and clamp 92, and clamping screw 94. The retaining plate 92 closes the slot 90 as shown in FIG. 4 thereby eliminating the need to fill the slot 90 with a knock-out/pryout panel or a removable plug.

The junction box includes features that ease the effort required to connect the electrical supply 78 to the fixture wires 31. The cover plate can be easily removed by lifting the edge of the retaining clip. The Romex® cable 78*a* can be inserted into a cable slot 90 and then held securely by a retaining plate 92 and clamping screw 94. The wire connections are then made and the cover plate replaced under the retaining clip.

Manufacture of the Fixture.

Another important feature of the present invention derived from its design features is manufacturing efficiency. Manufacturing efficiency is achieved by having a common mounting frame assembly 14 designed to accommodate differently sized and shaped lamp housings. Such lamp housings for example can be round, multi-sided, or oval. This feature provides efficiency in manufacture by reducing the production quantities of non-standard parts, resulting in reduced inventory and simplified production procedures and processes.

The fixture is assembled as an up-side-down stack of parts starting with the junction box retaining clip 36, followed by the junction box frame 23, retaining plate 92, and ground wire 96, all fastened together by rivet 98. The junction box assembly 20 is then attached to the mounting frame assembly 14 by inserting and bending the interlocking keys 32 into the mounting plate 16. An additional base plate (not depicted) maybe added between the junction box assembly and the mounting frame when necessary for code compliance or when additional structural strength is required.

The hanger bars 22 are assembled apart from the mounting plate 16 with the retaining clip 44. The hanger bars are inserted into the retaining channel 40 of the mounting frame assembly 14. The locking tabs 45 of the retaining clip 44 are bent thereby preventing the bars from disengaging from the frame assembly. The mounting bracket assembly 18 and the cylindrical lamp housing 12 are then attached to the mounting frame assembly 14 thereby completing the recessed lamp fixture 10.

The present invention may be embodied in other specific forms without departing from the spirit or essential attributes thereof and, accordingly, reference should be made to the appended claims, rather than to the foregoing specification, as indicating the scope of the invention.

It is claimed:

1. A recessed-lighting fixture, comprising:

a mounting frame adapted to support a lamp housing and a hanger assembly comprising one or two hanger bars with opposing ends adapted to engage a supporting structure of a wall or ceiling, each hanger bar having two brackets, a first bracket and a second bracket, wherein a flexible tab is formed into a nailer at one end of the first bracket for securing said hanger bar ends to said wall or ceiling support structure, and wherein the nailer has a fish hook like barb formed at its end for preventing the nailer from disengaging from said wall or ceiling support structure.

2. The recessed-lighting fixture of claim 1, wherein each bracket has a channel formed longitudinally along its entire length thereby maintaining the brackets in slidable engagement to each other, the brackets being retained in slidable engagement together by a retaining clip.

3. The recessed-lighting fixture of claim 2, wherein the brackets are retained together by a removable retaining clip, said removable retaining clip having two tabs for engaging one or both of the hanger bars.

4. The recessed-lighting fixture of claim 1, wherein the hanger bars are retained and released from the mounting frame by a retaining tab formed in the frame.

5. The recessed-lighting fixture of claim 1, wherein the hanger bars are made from deformable metal.

6. The recessed-lighting fixture of claim 1, wherein the flexible tab is formed at the second end of the first and second brackets, for securing said hanger bar ends to a T-grid ceiling channel.

7. The recessed-lighting fixture of claim 1, wherein a flexible tab is formed into a nailer at both opposing ends of the first and second brackets for securing said hanger bar ends to said wall or ceiling support structure, wherein the nailer at both opposing ends of the first and second brackets has a fish hook like barb formed at its end for preventing the nailer from disengaging from said wall or ceiling support structure.

8. A mounting frame for a recessed-lighting fixture, comprising:

(a) a plate having two longer opposing sides and two shorter opposing sides;

(b) a mounting bracket attached to an end of the plate and fastened to a lamp housing of a recessed-lighting fixture;

(c) a junction box having a frame fixed to the plate, said junction box providing electrical supply wiring to the lamp housing;

(d) hanger means attached to at least one side of the plate;

(e) wherein the junction box has one or more openings for a supply wire, and at least one such opening has a retaining bracket and a clamping screw, wherein the supply wire enters the one or more openings and is secured to the junction box by a clamping force between the retaining bracket and the junction box frame, said clamping force being adjustable by a clamping screw.

9. The recessed-lighting fixture of claim 6, wherein the retaining bracket closes the one or more openings for the supply wire.

10. The recessed-lighting fixture of claim 7, wherein the supply wire opening is at a corner formed by the frame of the junction box.

11. The recessed-lighting fixture of claim 10, wherein the junction box has an opening to engage the thread pitch of a common armored supply cable.

12. The recessed-lighting fixture of claim 11, wherein the junction box has an opening to engage a common supply cable by means of a common supply cable clamp adapter.

13. A recessed-lighting fixture having a housing, said housing comprising:

(a) a cylindrical body having a top end and an opposing bottom end;

(b) a first opening at the top end of the cylindrical body for entry of an electrical supply line;

(c) a second opening between the opposing ends for entry of a fastener means; and (d) a top bracket attached to the top end of the cylindrical body, said top bracket partially closing said first opening until contact is made with the electrical supply line.

14. The recessed-lighting fixture of claim 13, wherein the cylindrical body is attached to a mounting frame having a mounting bracket adapted to receive the housing.

15. The recessed-lighting fixture of claim 14, wherein the mounting bracket has a "V-Shaped" face for engaging the cylindrical housing.

16. The recessed-lighting fixture of claim 15, wherein the cylindrical body has a diameter between 4 and 6-½ inches.

17. The recessed-lighting fixture of claim 16, wherein the first opening engages the thread pitch of a common armored supply cable.

18. The recessed-lighting fixture of claim 17, wherein the first opening engages a common supply cable by means of a common supply cable clamp adapter.

* * * * *